United States Patent [19]

Buras, Jr. et al.

[11] 4,139,940

[45] Feb. 20, 1979

[54] ELECTRIC SHAVER

[75] Inventors: Edmund M. Buras, Jr., Silver Spring, Md.; Allan C. Harper, Andover, Mass.

[73] Assignee: The Gillette Company, Boston, Mass.

[21] Appl. No.: 849,523

[22] Filed: Nov. 7, 1977

Related U.S. Application Data

[63] Continuation-in-part of Ser. No. 750,212, Dec. 13, 1976, abandoned.

[51] Int. Cl.[2] ..... B26B 19/02

[52] U.S. Cl. ..... 30/43.92; 30/346.51

[58] Field of Search ..... 30/34.2, 43.91, 43.92, 30/346.51

[56] References Cited

U.S. PATENT DOCUMENTS

| | | | |
|---|---|---|---|
| 2,325,267 | 7/1943 | Murphy | 30/43.92 |
| 2,440,586 | 4/1948 | Jost | 30/43.92 |
| 2,590,452 | 3/1952 | Peterson | 30/43.91 X |
| 2,616,169 | 11/1952 | Hafland | 30/346.51 X |
| 3,169,313 | 2/1965 | King | 30/43.92 |
| 3,844,034 | 10/1974 | Limberg | 30/43.92 |

FOREIGN PATENT DOCUMENTS

| | | | |
|---|---|---|---|
| 2329370 | 1/1975 | Fed. Rep. of Germany | 30/346.51 |

*Primary Examiner*—Gary L. Smith

*Attorney, Agent, or Firm*—Richard A. Wise; Donald E. Mahoney

[57] ABSTRACT

An electric shaver is arranged to alleviate a cause of psuedofolliculitis by cutting low-lying facial hairs to a predetermined length. The electric shaver comprises a movable cutter and a perforated shaving foil having ribs protruding from a surface normally placed in contact with a user's beard. The shaving foil is arranged to move simultaneously with the cutter so that the ribs might lift and direct low-lying facial hairs through the perforations in the foil for shearing by the moving cutter.

3 Claims, 4 Drawing Figures

10
18
54
56
58
62
64
24
60
16
48
46
61
20
22
22
20
47
50
49
44
42
14
12
34
36
38
40
26
28
30
32

10
62
64
54
58
24
18
20
20
48
46
16
49
51
52
47
50
12
44

ELECTRIC SHAVER

This is a continuation-in-part of application Ser. No. 750,212, filed on Dec. 13, 1976, now abandoned.

BACKGROUND OF THE INVENTION

1. Field of the Invention

This invention relates to electric shavers and, more particularly, to electric shavers adapted to erect low-lying facial hairs for cutting above the skin line.

2. Description of the Prior Art

Implements such as razors or electric shavers for cutting or shaving hair are well known in the prior art. Conventional shaving implements include a handle adapted to be manually held and means for mounting a blade on the handle. Most prior art shaving implements for cutting human facial hair are designed to cut hair close to the skin level and preferably beneath that level without nicking or cutting the skin. Toward this end, electric shavers have included a guard member or outer foil vibrated at an ultrasonic rate to substantially enhance the ability of facial hairs to enter guard apertures and be cut by a moving shear cutter to provide high cutting efficiency and close shaves. An example of such a shaving implement is disclosed in U.S. Pat. No. 3,756,105 entitled "Ultrasonic Electric Shaver," issued to Lewis Balamuth et al, on Sept. 4, 1973. Another electric dry shaver having a perforated freely rotatable outer foil or shear plate for following facial contours and improving operating efficiency is disclosed in U.S. Pat. No. 2,526,153 entitled "Multihead Dry Shaver," issued to Herbert E. Page on Oct. 17, 1950. However, prior art shaving implements designed to provide a close shave are unsuitable for use by people who suffer from a condition of pseudofolliculitis or inflammation of one or more hair follicles and pseudofollicles caused by ingrown hairs. It has been determined that pseudofolliculitis occurs in two principal forms of abnormal beard hair growth. First, beard hairs cut below the skin line may grow to penetrate the walls of their follicles in which they are growing and continue to grow along paths within the dermis or epidermis beneath the stratum corneum. Second, beard hairs growing along paths substantially parallel to the skin surface may penetrate folds or mounds of skin lying across their paths to form pseudofollicles which may become inflamed. It has been determined that both of these kinds of abnormal beard hair growth can be prevented by means of electric shaver and foil design according to the invention. Ingrown hairs of the first type are prevented by cutting all hairs above the skin line so as to negate the possibility of their penetrating the follicle wall. Ingrown hairs of the second type are prevented by cutting them before they attain sufficient length to span a furrow separating them from an adjacent fold of skin.

Shaving instruments such as prior art blade razors and electric shavers having a perforated stationary outer shaving foil are adapted to cut erect hairs at, and preferably below the skin line. This effect is obtained because the fluid-like nature of the fleshy layers beneath the skin permit razors or electric shavers to apply sufficient force to depress the skin around a beard hair causing the beard hair to protrude from the skin level by a length substantially equal to one or more hair diameters (the diameter of an adult beard hair is about 0.005 inch). In addition to depressing the skin around the hair, the fluid-like nature of the fleshy substrate permits the beard hair and immediately adjacent skin to protrude into the holes in a prior art electric shaver foil having a thickness generally less than 0.005 inch. It will be appreciated that a relatively thin electric shaver foil enables the cutter blades to shear or cut the hair substantially at the depressed skin level. When the force applied against the skin by a prior art razor or electric shaver is removed, it has been determined that beard hairs are often cut below the skin level or skin line. It has also been determined that hairs cut below the skin line tend to cause a pseudofolliculitis problem since such hairs sometimes become ingrown by penetrating the wall of the follicle and growing under the skin.

Prior art blade razors and electric shavers fail to exert sufficient lifting action on hairs growing substantially parallel to the skin surface. Hence, they remain uncut after repeated shaving, and grow to a length sufficient to penetrate and enter adjacent skin folds.

Obviously, a shaving implement designed to cut facial hair at or slightly above the skin line would probably prevent one cause of pseudofolliculitis. For example, shaving implements such as a prior art electric clipper with a stationary cutter normally held in contact with a user's beard are adapted to cut hair above the skin line. However, such a prior art electric clipper would not cut hairs emerging from the skin at a low angle. These low-lying hairs are a cause of pseudofolliculitis when they become ingrown by penetrating the stratum corneum across furrows and crevices in rough skin after about 2 days growth.

Accordingly, an electric shaving implement is arranged to cut hair, including low-lying facial hairs, so that all hairs are cut above the skin line and to a length selected to minimize future penetration of the cut hair into the skin.

SUMMARY OF THE INVENTION

An electric shaver comprises a shaving foil having a plurality of apertures extending from a shaving foil outer surface to a shaving foil inner surface and a plurality of projections from the shaving foil front surface. Cutting means are positioned substantially adjacent to the shaving foil inner surface. Motor means are arranged to simultaneously move the shaving foil and cutting means.

DESCRIPTION OF THE PREFERRED EMBODIMENT

Figure 1:
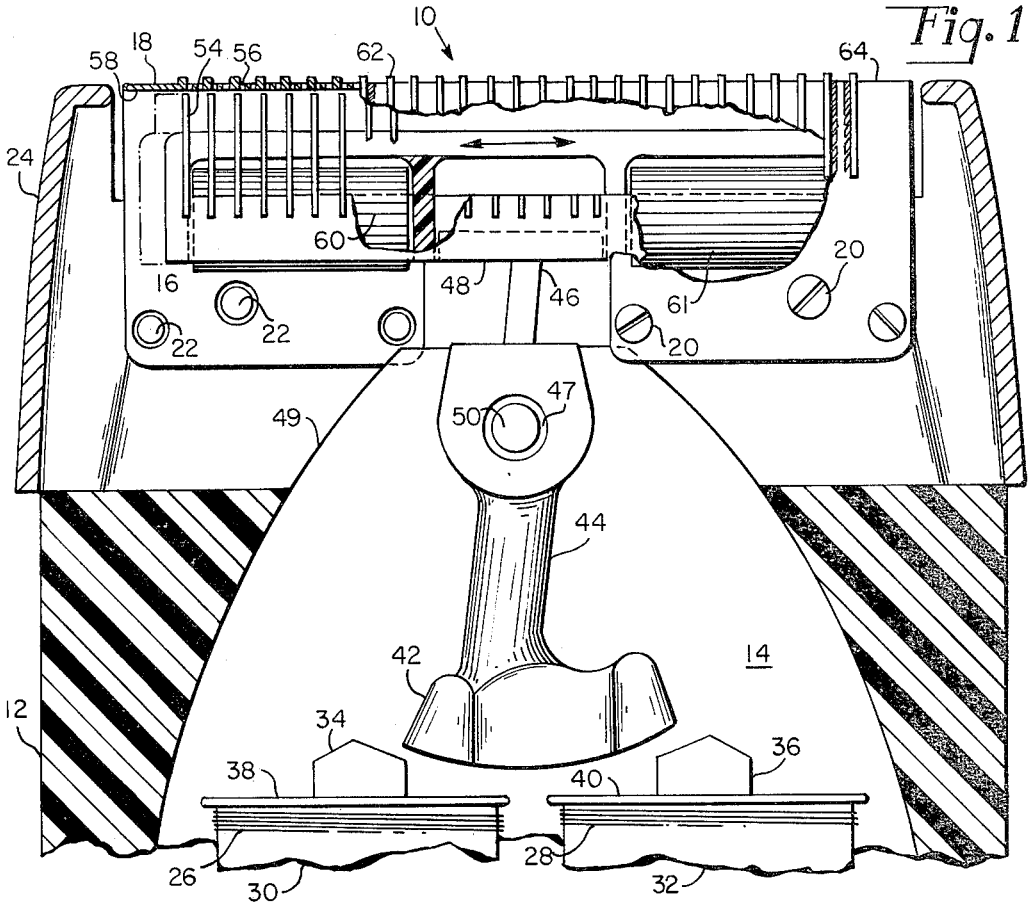
FIGS. 1 and 2 are frontal and side views of an electric dry shaver partially sectioned to reveal principal parts according to the invention.
Figure 2:
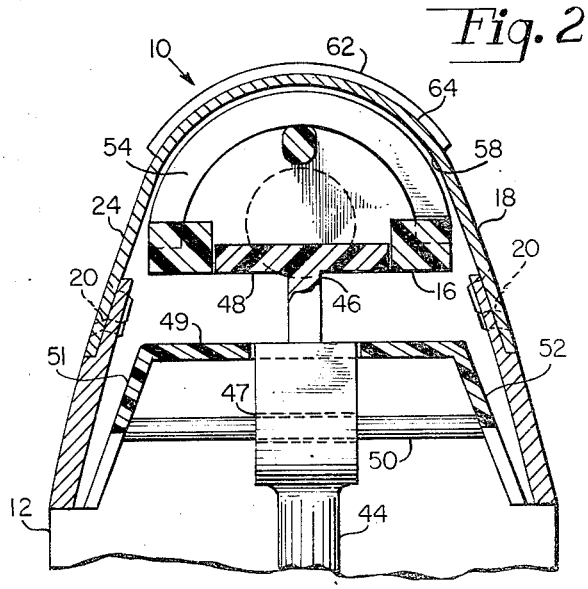

Referring to FIGS. 1 and 2, there is shown frontal and side views, respectively, of an electric dry shaver 10 partially sectioned to reveal principal parts. A housing 12 of insulating material encases a suitable motor 14 arranged to reciprocally move a blade block 16 in a lateral direction. A perforated cutting foil 18 or plate is attached by screws 20 inserted through clearance holes 22 in the foil and threaded into a metallic cutting head frame 24 attached to the housing 12. For example, the motor 14 may be an oscillating armature type with a stator including stator windings 26 and 28 wound around laminated iron cores 30 and 32 having pole shoes 34 and 36 extending from adjacent core ends 38 and 40. A lower end 42 of an armature 44 is disposed between the pole shoes 34 and 36. The stator is arranged in a known manner to provide a magnetic circuit for moving the lower end 42 of the armature 44 in an oscillating manner in response to an electrical current signal coupled to the windings 26 and 28 from a source, not shown. An upper end 46 of the armature 44 is slidably coupled to a bottom portion 48 of the blade block 16. The armature 44 is pivotally connected to a motor housing 49 by inserting a pivot pin 50 into a hole 47 in the armature 44 between the armature ends 42 and 46 and attaching ends of the pivot pin 50 to opposite sides 51 and 52 of the motor housing 49. Thus, when the motor 14 is activated by an electrical signal, the moving armature 44 causes the blade block 16 and attached semicircular blades 54 to reciprocally move in a lateral direction at a predetermined frequency. For example, the blade block 16 may be moved at 120 cycles per second. It will be appreciated that hairs projecting through the perforations 56 in the cutting foil 18 are sheared by the moving blades 54 at an inner surface 58 of the cutting foil 18.

Prior art dry shavers have a shaving head generally comprising a stationary perforated cutting foil which engages the face and a movable blade block with blades adapted to cut or shear facial hair at a length substantially determined by the cutting foil thickness and the size of the foil perforations 56. Usually, prior art cutting foils are made very thin in order to cut hairs below the skin line. Unlike prior art dry shavers, the cutting foil 18 of the present invention is relatively thick and includes projections 62 on an outer surface 64 of the foil 18. The projections 62 are designed to move and to lift low-lying facial hairs for cutting by the blades 54 to a length terminating slightly above the skin line. As well known in the prior art, a forced vibration of an unbalanced body mounted on springs or other elastic supports is produced when a periodically varying force is applied to the unbalanced body. The forced vibrations are, in turn, transmitted to a supporting member, such as a shaver casing, supporting the vibrating unbalanced body. Thus, means for moving the cutting foil 18 and projections 62 include weights 60 and 61 attached to the blade block 16 and positioned beneath and against the cutter blades 54 to unbalance the blade block 16 so that lateral movement of the unbalanced blade block 16 causes the housing 12 and the attached cutting foil 18 and projections 62 to vibrate and reciprocally move in a lateral direction. An example of the projections 62 include a plurality of ribs formed on outer surface 64 of the cutting foil 18. Under operating conditions, the moving cutting foil 18 is pressed against a user's face so that the ribs 62 rub against the face to erect and direct low-lying facial hairs into the perforations 56 between the ribs. Hairs projecting through the perforations 56 are then cut by the moving blades 54 at the inner surface 58 of the cutting foil 18. For example, it has been determined that the ribs 62 will satisfactorily direct low-lying facial hairs into the perforations 54 if the moving cutting foil 18 has a peak-to-peak lateral displacement of about 0.080 inch at a frequency of about 120 cycles per second.

Figure 3:
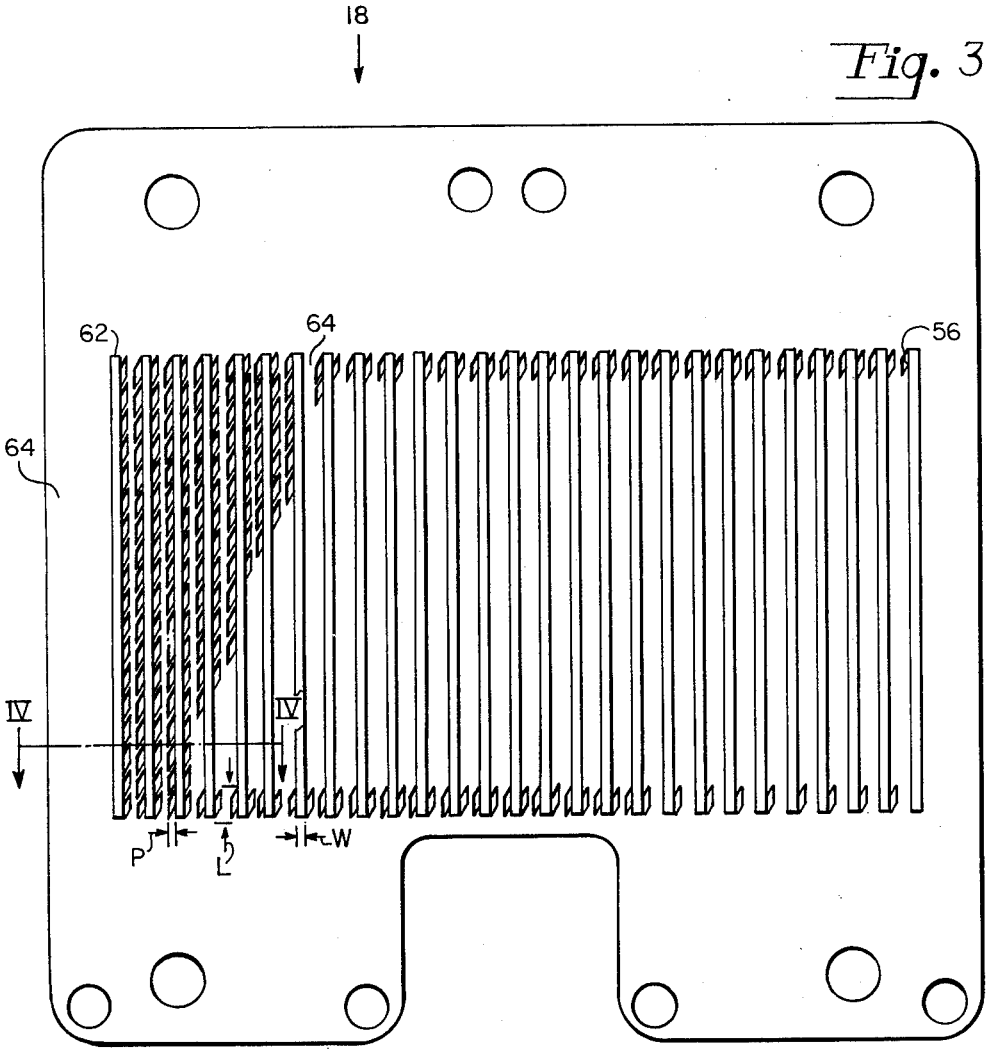
FIG. 3 is a top view of a cutting foil.
Figure 4:
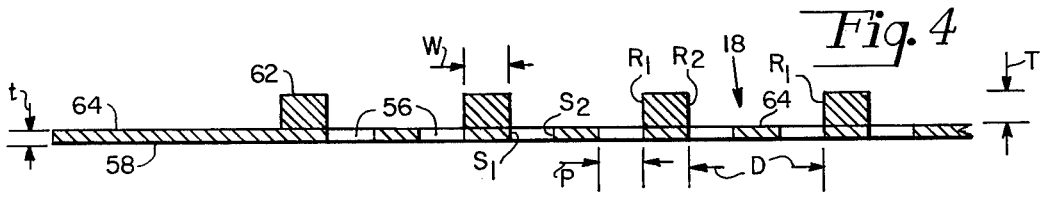
FIG. 4 is an edge view of a cutting foil.

Referring to FIGS. 3 and 4, there is shown top and edge views, respectively, of the cutting foil 18 with the perforations 56 designed to admit hair and reject skin without interfering with free movement of the cutter blades 54. For example, the perforations 56 are in the form of a parallelogram having opposing corner angles being either obtuse or acute and parallel walls or sides, $S_1$ and $S_2$, aligned substantially perpendicular to the direction of movement of the cutting blades 54 to prevent the cutting blades 54 from becoming jammed against the inner surface 58 of the foil 18. Each of the perforations 56 have a width, P, between walls, $S_1$ and $S_2$, selected to easily admit hair while preventing skin from being cut by the blades. It has been determined that a perforation width, P, equal to 0.015 inch and an overall length, L, equal to 0.050 inch is suitable for use in the cutting foil 18.

The perforations 56 and ribs 62 are cooperatively arranged to efficiently direct hairs into the perforations 56. For example, two columns of perforations 56 are disposed between pairs of ribs 62 with walls or sides, $R_1$ and $R_2$, aligned substantially parallel to the sides, $S_1$ and $S_2$, of the perforations 56. The ribs 62 have a width, W, of 0.020 inch and the sides, $R_1$ and $R_2$, of adjacent ribs are separated by a distance, D, of approximately 0.045 inch. The sides, $R_1$ and $R_2$, of the ribs 62 are coextensive with a side of an adjacent perforation 56 to permit the ribs 62 to easily direct hairs into the perforations 56. It is desired that hairs erected by the moving ribs 62 will tend to be directed into the perforations 56 against the rib walls, $R_1$ and $R_2$, and the coextensive wall, $S_1$, of the perforations 56 without interference from the remaining foil outer surface 64. The hairs directed into the perforations 56 by the ribs 62 are sheared or cut by the moving blades 54 to a minimum length substantially determined by thickness, t, of the cutting foil 18 and the size of the foil perforations 56. It has been determined that cutting facial hair to a length between 0.001 and 0.010 inch minimizes the possibility of future penetration by the cut hair into the skin when shaving is practiced daily. The dimensions of the foil perforations 56, the thickness, t, of the foil 18 determine the minimum length that hair will be cut. The dimensions of the thickness, T, of the ribs 62 and the separation, D, between ribs 62 are selected so that the ribs 62 would not substantially interfere with cutting hair to a desired length. Accordingly, the thickness, t, of the cutting foil 18 is selected to be 0.005 inch to prevent hairs from being cut below the skin line and thickness, T, of the ribs 62 is 0.010 inch when the distance, D, is 0.045 inch.

One embodiment of the invention has been shown and described by way of example. Various other embodiments and modifications thereof will be apparent to those skilled in the art, and will fall within the scope of the invention as defined in the following claims.

What is claimed as new and desirous to be secured by Letters Patent of the United States is:

1. An electric shaver comprising:

a plurality of projections extending from an outer surface of a shaving foil having a plurality of apertures, each of said apertures extending from a shaving foil outer surface to a shaving foil inner surface to form an aperture wall coextensive with a wall of one of said projections on said shaving foil outer surface, said shaving foil having a thickness equal to or exceeding 0.005 inch;

cutting means positioned substantially adjacent to said shaving foil inner surface;

weights attached to said cutting means for unbalancing said cutting means; and motor means for reciprocally moving said unbalanced cutting means against said shaving foil causing said shaving foil to vibrate, said apertures being arranged in only two columns between a pair of said projections separated by a predetermined distance selected to enable said projections on said vibrating foil to raise and direct low-lying hairs against said coextensive walls of said projections and apertures and into only apertures adjacent to said projections for cutting by said cutting means to a length between 0.001 and 0.010 inch determined by dimensions of said foil thickness and said apertures.

2. An electric shaver according to claim 1, wherein said shaving foil is vibrated to reciprocally move in a lateral direction.

3. An electric shaver according to claim 2, wherein said projections are substantially parallel ribs longitudinally extending across said shaving foil outer surface in a direction substantially perpendicular to said lateral direction of movement of said shaving foil.

* * * * *